US010714804B2

(12) United States Patent
Miyamoto et al.

(10) Patent No.: US 10,714,804 B2
(45) **Date of Patent: *Jul. 14, 2020**

(54) COAXIAL WIRING DEVICE AND TRANSMISSION/RECEPTION INTEGRATED SPLITTER

(71) Applicant: NEC Corporation, Tokyo (JP)

(72) Inventors: Takahiro Miyamoto, Tokyo (JP); Norihisa Shiroyama, Tokyo (JP); Kiyotake Sasaki, Tokyo (JP); Sumio Ueda, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/432,684

(22) Filed: Jun. 5, 2019

(65) Prior Publication Data

US 2019/0288362 A1 Sep. 19, 2019

Related U.S. Application Data

(63) Continuation of application No. 15/704,696, filed on Sep. 14, 2017, now Pat. No. 10,347,959, which is a (Continued)

(30) Foreign Application Priority Data

Oct. 7, 2013 (JP) ..... 2013-210073

(51) Int. Cl.
*H01P 3/08* (2006.01)
*H01P 1/209* (2006.01)

(Continued)

(52) U.S. Cl.
CPC ..... *H01P 3/08* (2013.01); *H01P 1/203* (2013.01); *H01P 1/209* (2013.01); *H01P 1/213* (2013.01);

(Continued)

(58) Field of Classification Search
CPC .. H01P 3/08; H01P 3/085; H01P 3/087; H01P 1/203; H01P 1/209; H01P 1/213; H01P 1/2135; H01P 5/103; H01P 11/00
See application file for complete search history.

(56) References Cited

U.S. PATENT DOCUMENTS 4,032,849 A 6/1977 Gysei et al.
6,147,575 A 11/2000 Hiratsuka et al.

(Continued)

FOREIGN PATENT DOCUMENTS

EP 0274859 A1 7/1988
JP 59-99825 6/1984

(Continued)

OTHER PUBLICATIONS

International Search Report dated Dec. 22, 2014, in corresponding PCT International Application.

(Continued)

*Primary Examiner* — Hoang V Nguyen
(74) *Attorney, Agent, or Firm* — Finnegan, Henderson, Farabow, Garrett & Dunner, L.L.P.

(57) ABSTRACT

Conventional coaxial wiring devices present a problem in that the management of the manufacturing process therefor is difficult. A coaxial wiring device according to the present invention includes a first member, a second member, and a conductor plate. The first member (10) and the second member (30) include, when a line that connects a first port and a second port is denoted by a reference line, a first groove (11) that has a central point on the reference line and extends in a direction that intersects with the reference line; a second groove (12) that connects one end (FN1) of the first groove (11) and the first port; a third groove (13) that connects the other end (FN2) of the first groove (11) and the first port and has a shape that is line symmetrical to the second groove (12) with respect to the reference line; a (Continued)

fourth groove (14) that connects one end (FN1) of the first groove (11) and the second port; and a fifth groove (15) that connects the other end (FN2) of the first groove (11) and the second port and has a shape that is line symmetrical to the fourth groove (14) with respect to the reference line.

4 Claims, 8 Drawing Sheets

Related U.S. Application Data continuation of application No. 15/027,506, filed as application No. PCT/JP2014/005043 on Oct. 3, 2014, now Pat. No. 9,793,590.

(51) Int. Cl.

| | |
|---|---|
| ***H01P 5/103*** | (2006.01) |
| ***H01P 1/213*** | (2006.01) |
| ***H01P 11/00*** | (2006.01) |
| ***H01P 1/203*** | (2006.01) |
| *H01P 5/107* | (2006.01) |

(52) U.S. Cl.

CPC ..... *H01P 3/085* (2013.01); *H01P 3/087* (2013.01); *H01P 5/103* (2013.01); *H01P 11/00* (2013.01); *H01P 1/2135* (2013.01); *H01P 5/107* (2013.01)

(56) References Cited

U.S. PATENT DOCUMENTS

| | | | | |
|---|---|---|---|---|
| 6,486,748 | B1 | 11/2002 | Stones et al. | |
| 9,793,590 | B2 * | 10/2017 | Miyamoto | H01P 1/203 |
| 10,347,959 | B2 * | 7/2019 | Miyamoto | H01P 3/085 |
| 2002/0033744 | A1 | 3/2002 | Sengupta et al. | |
| 2003/0001688 | A1 | 1/2003 | Thormar | |
| 2011/0140804 | A1 | 6/2011 | Fan | |
| 2012/0152454 | A1 | 6/2012 | Mass et al. | |

FOREIGN PATENT DOCUMENTS

| | | |
|---|---|---|
| JP | 4-7903 | 1/1992 |
| JP | 2005-252486 | 9/2005 |
| JP | 2008-283452 | 11/2008 |
| JP | 4411315 | 2/2010 |
| WO | WO 2007/149046 A1 | 12/2007 |
| WO | WO 2012/078985 A1 | 6/2012 |

OTHER PUBLICATIONS

Extended European Search Report dated May 17, 2017, by the European Patent Office in counterpart European Patent Application No. 14852846.6.

* cited by examiner

COAXIAL WIRING DEVICE AND TRANSMISSION/RECEPTION INTEGRATED SPLITTER

CROSS-REFERENCE TO RELATED PATENT APPLICATIONS

This application is a continuation of U.S. patent application Ser. No. 15/704,696, filed Sep. 14, 2017, which is a continuation of U.S. patent application Ser. No. 15/027,506, filed Apr. 6, 2016, which is a National Stage Entry of International Application No. PCT/JP2014/005043, filed Oct. 3, 2014, which claims priority from Japanese Patent Application No. 2013-210073, filed Oct. 7, 2013. The entire contents of the above-referenced applications are expressly incorporated herein by reference.

TECHNICAL FIELD

The present invention relates to a coaxial wiring device and a transmission/reception integrated splitter and relates to, for example, a coaxial wiring device and a transmission/reception integrated splitter that transmit signals between a first port and a second port provided on a coaxial transmission system.

BACKGROUND ART

A coaxial wire is used to transmit high-frequency signals. Such a coaxial wire includes a coaxial wiring device in which a wire formed of a conductor is provided inside a coaxial tube formed of grooves provided in a first member and a second member and high-frequency signals are transmitted. Patent Literature 1 to 3 disclose examples of the coaxial wiring device.

Patent Literature 1 discloses a resonator including a signal input/output line, a first resonating part, a second resonating part, and a first connecting line and formed in a coplanar plane circuit having ground conductors 105 on both sides thereof.

Patent Literature 2 discloses a band-rejection filter that includes a plurality of dividing members in which a first groove and a second groove are formed, the first groove extending in a pipe axial direction and forming a waveguide, and the second groove connected to the first groove and forming a resonator, and a metallic plate arranged between the plurality of dividing members, in which the metallic plate includes an adjusting unit for adjusting filter characteristics in a part corresponding to the second groove.

Patent Literature 3 discloses a coaxial wiring device in which a wire formed of a conductor is formed inside a coaxial tube formed of grooves provided in a first member and a second member and high-frequency signals are transmitted.

CITATION LIST

Patent Literature

[Patent Literature 1] Japanese Unexamined Patent Application Publication No. 2008-283452

[Patent Literature 2] Japanese Patent No. 4411315

[Patent Literature 3] Japanese Unexamined Patent Application Publication No. 59-099825

SUMMARY OF INVENTION

Technical Problem

It is required to design the signal path that transmits the high-frequency signals so that filter characteristics or the like are adjusted with a high accuracy. Therefore, when the coaxial wiring device that transmits the high-frequency signals is manufactured, it is required to strictly manage elements of the coaxial wiring device.

Solution to Problem

One exemplary aspect of a coaxial wiring device according to the present invention is a coaxial wiring device including a first member, a second member that is opposed to the first member, and a conductor plate that is provided to be held between the first member and the second member, in which a signal is transmitted between a first port and a second port that are provided on respective ends of a coaxial wire formed in the conductor plate by grooves provided in the first member and the second member and the coaxial wire, in which, when a line that connects the first port and the second port is denoted by a reference line, the first member and the second member include: a first groove that has a central point on the reference line and extends in a direction that intersects with the reference line; a second groove that connects one end of the first groove and the first port; a third groove that connects the other end of the first groove and the first port and has a shape that is line symmetrical to the second groove with respect to the reference line; a fourth groove that connects one end of the first groove and the second port; and a fifth groove that connects the other end of the first groove and the second port and has a shape that is line symmetrical to the fourth groove with respect to the reference line.

Further, a transmission/reception integrated splitter according to the present invention includes, in addition to the above coaxial wiring device, a coaxial circulator that is connected to the first port, transmits a signal input from a first direction to the first port, and outputs a signal output from the first port to a second direction.

Advantageous Effects of Invention

According to the coaxial wiring device and the transmission/reception integrated splitter of the present invention, it is possible to simplify the manufacturing process and deal with changes in the specification in a flexible manner.

DESCRIPTION OF EMBODIMENTS

First Exemplary Embodiment

Figure 1:
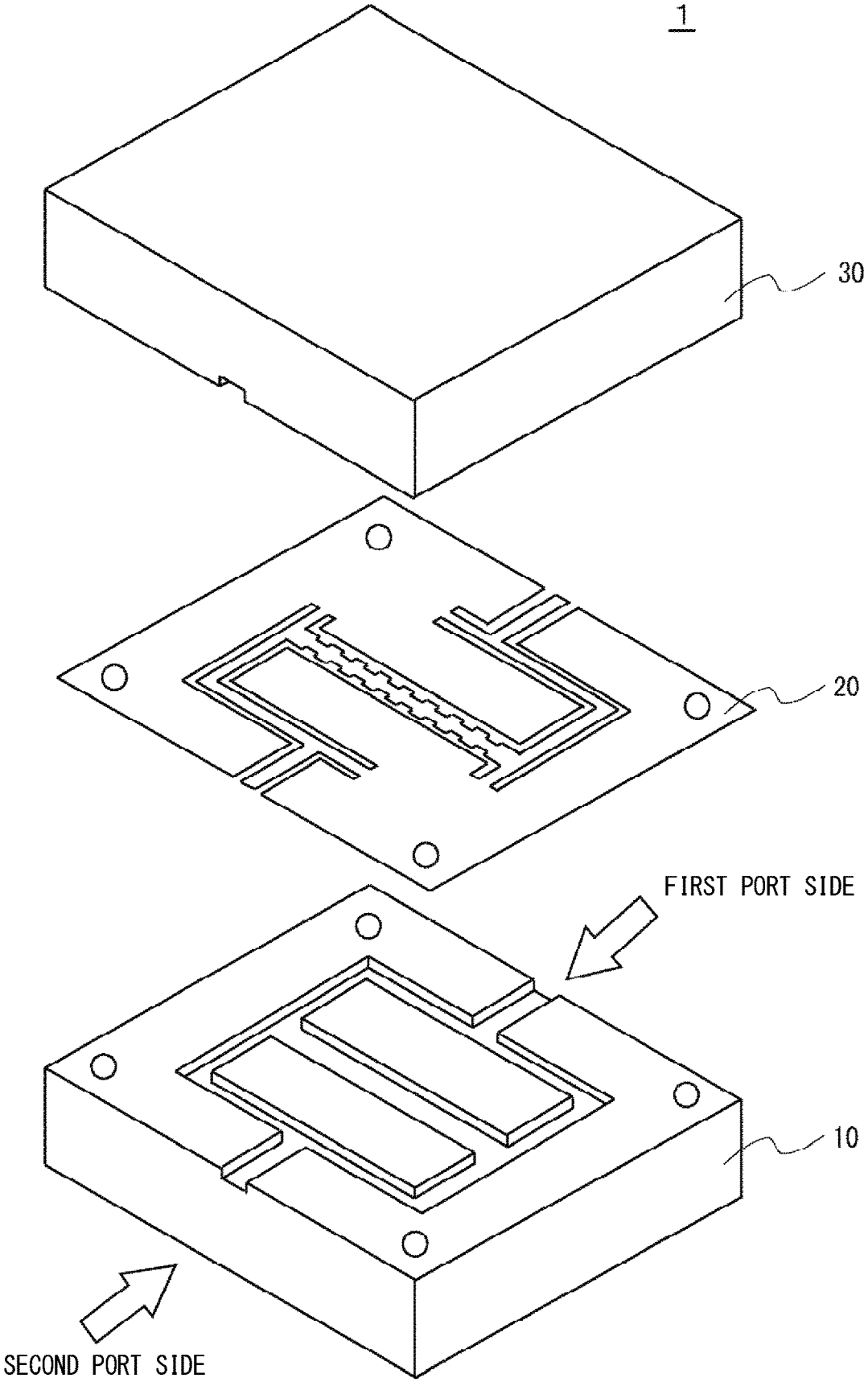
FIG. 1 is a schematic view of a coaxial wiring device according to a first exemplary embodiment.

Hereinafter, with reference to the drawings, exemplary embodiments of the present invention will be described. In the following description, for the sake of clarification of the description, the drawings are simplified as appropriate. FIG. 1 shows a schematic view of a coaxial wiring device 1 according to a first exemplary embodiment.

As shown in FIG. 1, the coaxial wiring device 1 according to the first exemplary embodiment includes a first member 10, a conductor plate 20, and a second member 30. The first member 10, the second member 30, and the conductor plate 20 are, for example, metal such as stainless or copper.

In the coaxial wiring device 1 according to the first exemplary embodiment, grooves having the same shape are formed on surfaces of the first member 10 and the second member 30 opposed to each other. Further, the coaxial wiring device 1 according to the first exemplary embodiment forms the conductor plate 20. In the coaxial wiring device 1, the first member 10, the conductor plate 20, and the second member 30 are used in a state in which they are superimposed and in tight contact with one another. At this time, grooves in the first member 10 and the second member 30 and the coaxial wire of the conductor plate 20 are formed so that the coaxial wire formed in the conductor plate 20 is located in a tube formed of the grooves formed in the first member 10 and the second member 30.

The coaxial wiring device 1 according to the first exemplary embodiment transmits signals from one end to the other end of the coaxial wire. In the following description, one end of the coaxial wire is referred to as a first port and the other end of the coaxial wire is referred to as a second port.

The characteristics of the coaxial wiring device 1 according to the first exemplary embodiment lie in the shape of the grooves formed in the first member 10 and the second member 30 and the shape of the coaxial wire of the conductor plate 20. In the following description, the characteristic part of each member will be described in further detail.

Figure 2:
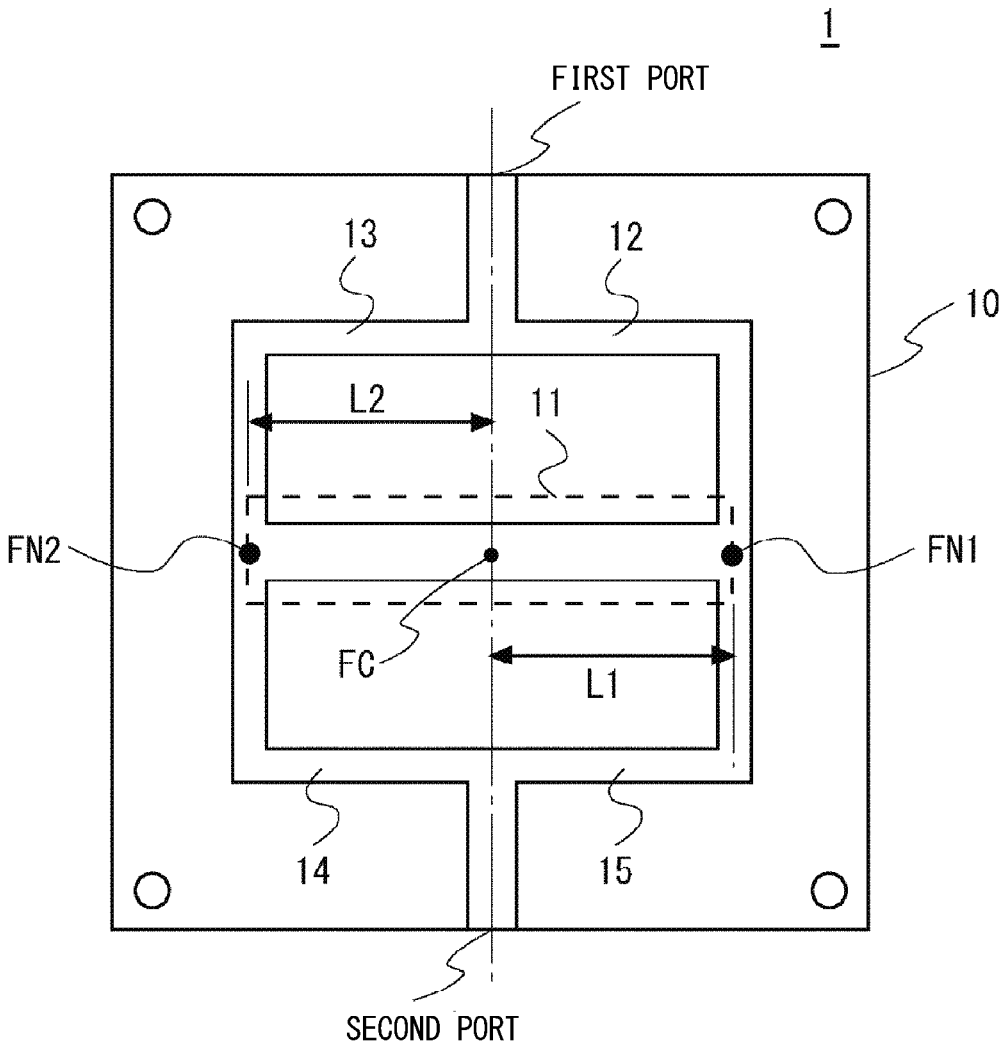
FIG. 2 is a diagram for describing a shape of grooves formed in a first member of the coaxial wiring device according to the first exemplary embodiment.

First, the shape of the grooves formed in the first member 10 and the second member 30 will be described. Since the grooves formed in the first member 10 and the grooves formed in the second member 30 have the same shape, only the grooves formed in the first member 10 will be described. FIG. 2 shows a diagram for describing the shape of the grooves formed in the first member of the coaxial wiring device 1 according to the first exemplary embodiment.

As shown in FIG. 2, the grooves formed in the first member 10 are formed to be symmetrical with respect to a reference line that connects the first port and the second port. More specifically, a first groove 11, a second groove 12, a third groove 13, a fourth groove 14, and a fifth groove 15 are formed in the first member 10.

The first groove 11 is formed so that it has a central point FC on the reference line and extends in a direction that intersects with the reference line. When the distance between one end FN1 of the first groove 11 and the reference line is denoted by L1 and the distance between the other end FN2 of the first groove 11 and the reference line is denoted by L2, the central point FC is located at the position where L1=L2. The second groove 12 is formed to connect one end FN1 of the first groove 11 and the first port. The third groove 13 is formed to connect the other end FN2 of the first groove 11 and the first port and to be line symmetrical to the second groove 12 with respect to the reference line. The fourth groove 14 is formed to connect one end FN1 of the first groove 11 and the second port. The fifth groove 15 is formed to connect the other end FN2 of the first groove 11 and the second port and to be line symmetrical to the fourth groove 14 with respect to the reference line.

Figure 3:
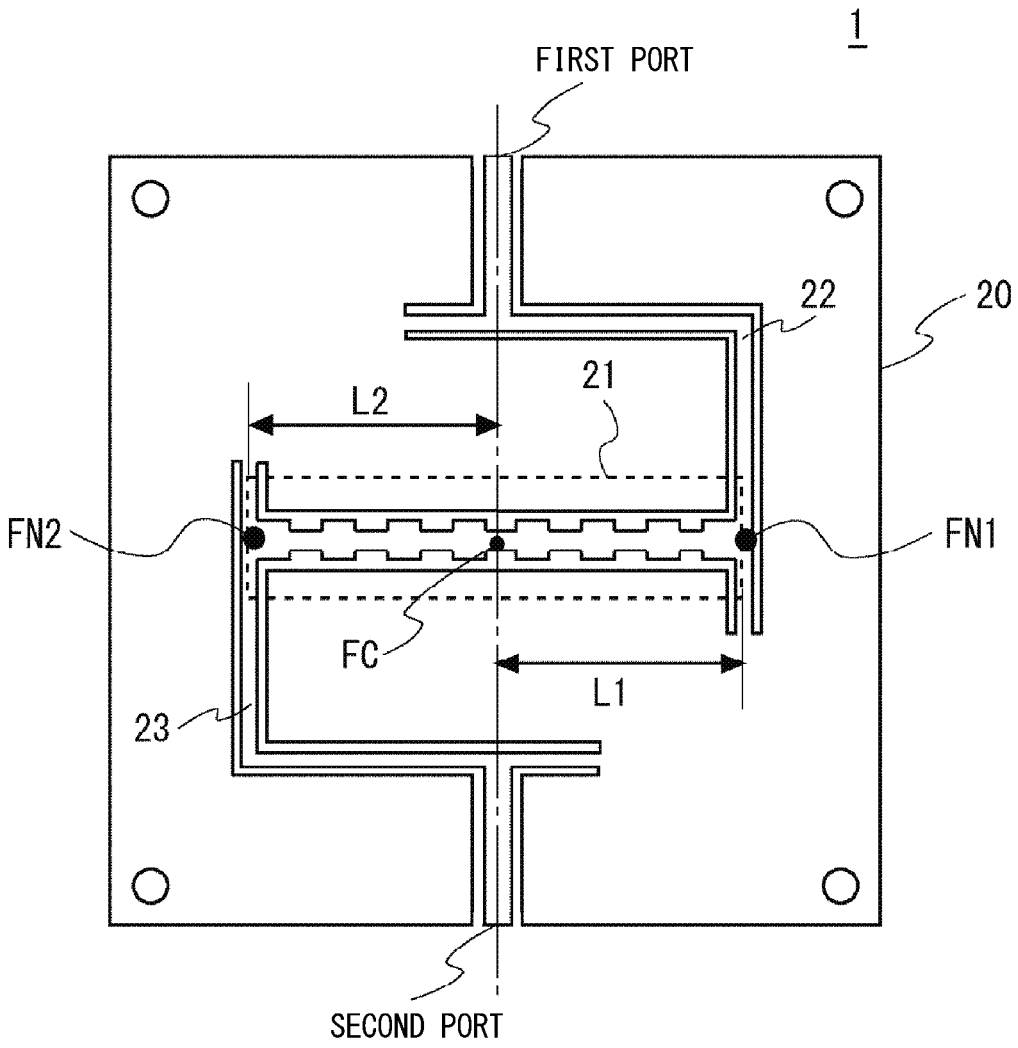
FIG. 3 is a diagram for describing a shape of a coaxial wire on a conductor plate of the coaxial wiring device according to the first exemplary embodiment.

Next, the shape of the coaxial wire formed in the conductor plate 20 according to the first exemplary embodiment will be described. FIG. 3 shows a diagram for describing the shape of the coaxial wire formed in the conductor plate 20 of the coaxial wiring device 1 according to the first exemplary embodiment. FIG. 3 shows the front surface of the conductor plate 20. Therefore, when the conductor plate 20 is seen from the rear side, the coaxial wire shown in FIG. 3 becomes line symmetrical with respect to the reference line that connects the first port and the second port.

As shown in FIG. 3, a first wire (e.g., filter wire 21), a second wire 22, and a third wire 23 are formed in the conductor plate 20. The filter wire 21 is formed in the position corresponding to the first groove. That is, the filter wire 21 is formed so that it has a central point FC on the reference line and extends in a direction that intersects with the reference line. When the distance between one end FN1 of the filter wire 21 and the reference line is denoted by L1 and the distance between the other end FN2 of the filter wire 21 and the reference line is denoted by L2, the central point FC is at the position where L1=L2. The second wire 22 is formed in the position corresponding to the second groove 12. The second wire 22 is formed in the position corresponding to the third groove 13 when the conductor plate 20 is turned over. The third wire 23 is formed in the position corresponding to the fourth groove 14. The third wire 23 is formed in the position corresponding to the fifth groove 15 when the conductor plate 20 is turned over.

Figure 4A:
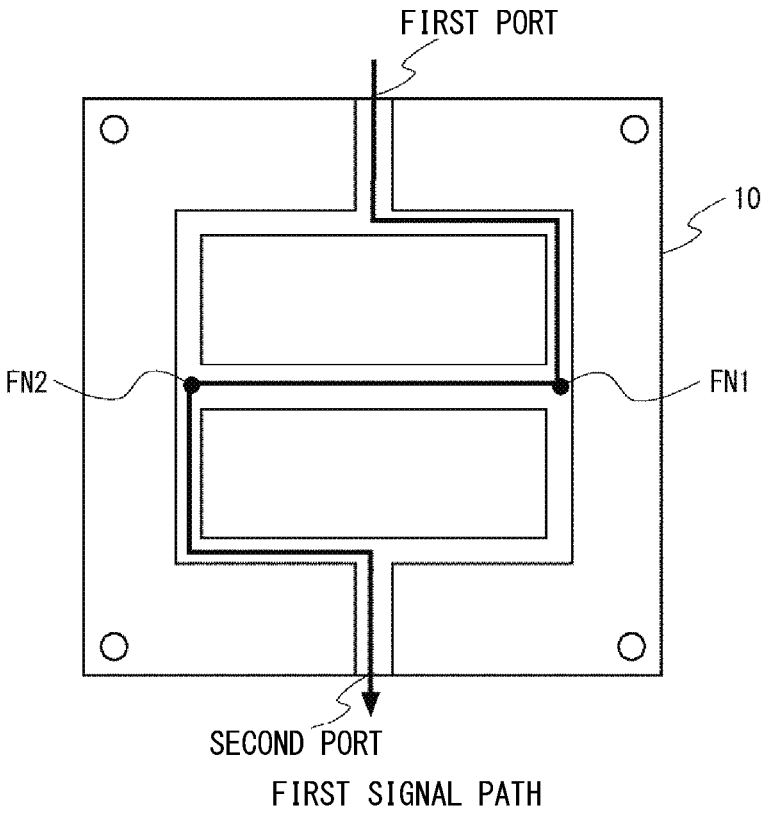
FIGS. 4A and 4B are diagrams for describing two signal paths formed in the coaxial wiring device according to the first exemplary embodiment.
Figure 4B:
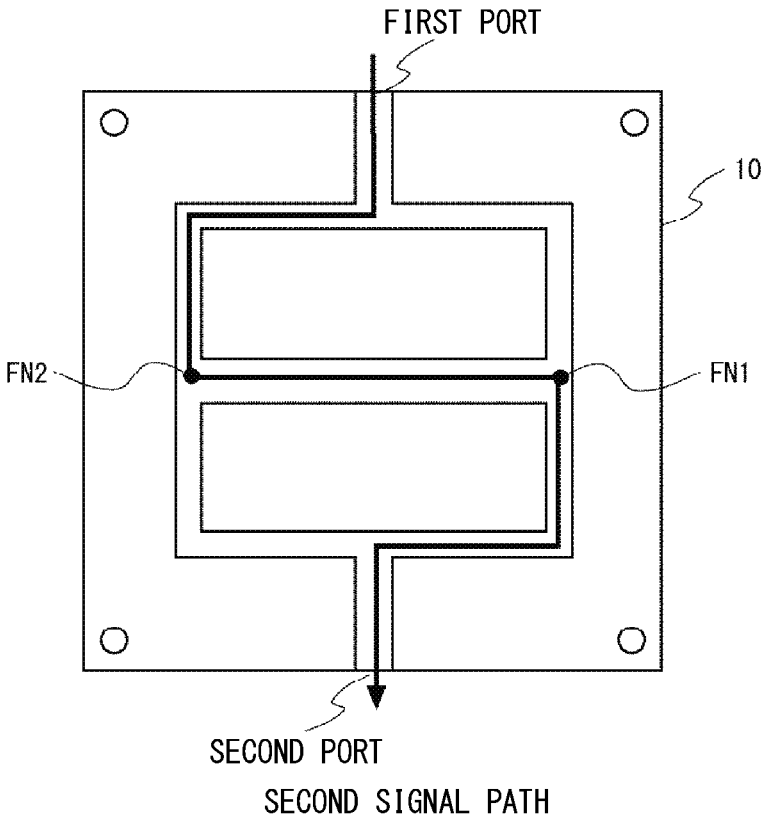

Next, a signal path of the coaxial wiring device 1 according to the first exemplary embodiment will be described. As described above, in the coaxial wiring device 1 according to the first exemplary embodiment, grooves that are line symmetrical with respect to the reference line are formed in the first member 10 and the conductor plate 20. Further, in the coaxial wiring device 1 according to the first exemplary embodiment, the filter wire 21 that passes the first path 11, the second wire 22 corresponding to one of the second path 12 and the third path 13, and the third wire 23 corresponding to one of the fourth path 14 and the fifth path 15 are formed in the conductor plate 20. According to this structure, in the coaxial wiring device 1 according to the first exemplary embodiment, it is possible to appropriately form the signal path either in the case in which the conductor plate 20 is arranged in such a way that the front side of the conductor plate 20 is opposed to the second member 30 or in the case in which the conductor plate 20 is arranged in such a way that the front side of the conductor plate 20 is opposed to the first member 10. FIGS. 4A and 4B show a diagram for describing two signal paths formed in the coaxial wiring device according to the first exemplary embodiment.

As shown in FIGS. 4A and 4B, in the coaxial wiring device 1 according to the first exemplary embodiment, a first path (upper stage FIG. 4A) and a second path (lower stage FIG. 4B) can be formed. The first path is a path that is formed when the surface of the conductor plate 20 is opposed to the second member 30. When this first path is formed, signals are transmitted in the order of the first port, one end FN1 of the first groove 11, the other end FN2 of the first groove 11, and the second port. Further, the second path is a path that is formed when the conductor plate 20 is arranged in such a way that the front surface of the conductor plate 20 is opposed to the first member 10. When this second path is formed, signals are transmitted in the order of the first port, the other end FN2 of the first groove 11, one end FN1 of the first groove 11, and the second port.

In accordance with the above description, in the coaxial wiring device 1 according to the first exemplary embodiment, either in the case in which the front surface of the conductor plate 20 is opposed to the first member 10 or in the case in which the front surface of the conductor plate 20 is opposed to the second member 30, the coaxial wire can be arranged inside the tube formed of the grooves formed in the first member 10 and the second member 30. Accordingly, in the coaxial wiring device 1 according to the first exemplary embodiment, the coaxial wiring device can be manufactured without considering which one of the front surface or the rear surface of the conductor plate 20 is opposed to the second member 30 in the manufacturing process.

While the example in which the first groove 11 is formed to be orthogonal to the reference line has been described in the above description, it is sufficient that the first groove 11 be formed to have a central point on the reference line and to intersect with the reference line. For example, the first groove 11 may be formed to intersect with the reference line in an oblique direction. In this case, the first groove 11 is formed to satisfy the three following conditions: that each of two grooves forming the first groove 11 has a central point on the reference line, the two grooves are formed to have the same length, and the two grooves intersect with each other. By forming the first groove 11 so that it becomes orthogonal to the reference line, the first groove 11 can be formed of one groove, whereby the manufacturing process can be simplified. Further, when the first groove 11 is formed of two grooves, the degree of freedom regarding the length of the coaxial wire can be increased.

While the filter wire 21 is used as the first wire corresponding to the first groove 11 in the above description, it is sufficient that the filter wire 21 be a coaxial wire and the first wire may not necessarily form a filter.

Second Exemplary Embodiment

In a second exemplary embodiment, another aspect of the coaxial wiring device 1 will be described. In the second exemplary embodiment, an example in which a waveguide coaxial converter is set in the position of the second port of the coaxial wiring device 1 according to the first exemplary embodiment will be described. In the description of the second exemplary embodiment, components the same as those in the first exemplary embodiment are denoted by reference symbols the same as those in the first exemplary embodiment and the descriptions thereof will be omitted.

Figure 5:
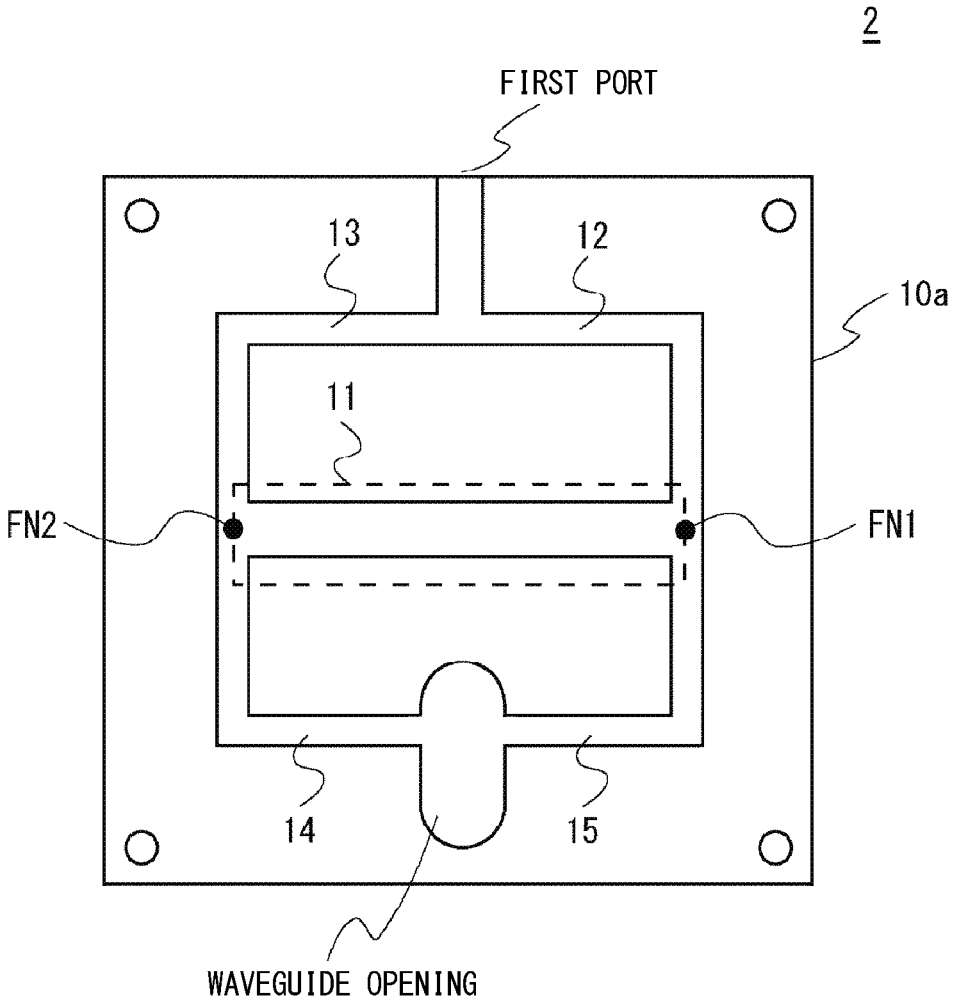
FIG. 5 is a diagram for describing a shape of grooves formed in a first member of a coaxial wiring device according to a second exemplary embodiment.

FIG. 5 shows a diagram for describing a shape of grooves formed in a first member of the coaxial wiring device according to the second exemplary embodiment. As shown in FIG. 5, in a coaxial wiring device 2 according to the second exemplary embodiment, a first member 10*a* is used in place of the first member 10. A waveguide opening, which serves as a waveguide, is provided in the first member 10*a*. This waveguide opening has such a shape that the second port is formed inside the opening and the waveguide opening becomes line symmetrical with respect to the reference line that connects the first port and the second port. Further, the waveguide opening forms a part of the waveguide. The waveguide that includes the opening of the first member 10 is formed to have such a depth that it penetrates the first member 10 but does not penetrate the second member 30.

Figure 6:
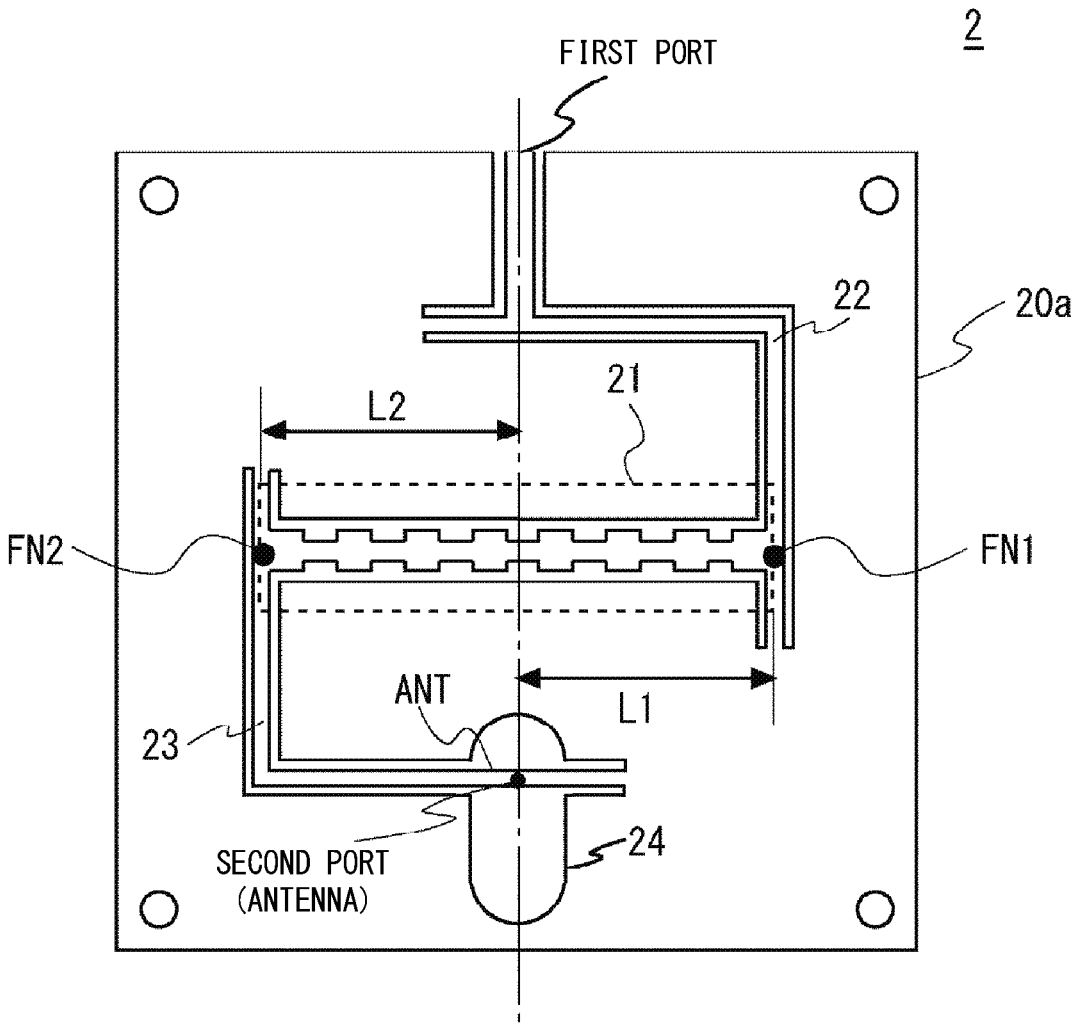
FIG. 6 is a diagram for describing a shape of a coaxial wire on a conductor plate of the coaxial wiring device according to the second exemplary embodiment.

Next, FIG. 6 shows a diagram for describing the shape of a coaxial wire on a conductor plate 20*a* of the coaxial wiring device 2 according to the second exemplary embodiment. This conductor plate 20*a* is used in place of the conductor plate 20. In the conductor plate 20*a*, an antenna part ANT is formed in the position corresponding to the second port. Further, the conductor plate 20*a* includes an opening 24 having a shape corresponding to the waveguide opening of the first member 10*a*. The antenna part ANT is formed to traverse the opening 24. Further, the antenna part ANT has one end that is successively formed with the third wire 23 and the other end that is connected to a conductor surface around the opening 24. The antenna part ANT is connected to the conductor surface in a region outside the opening 24. While the central point in the longitudinal direction of the antenna part ANT is located in the position of the second port, the whole antenna part ANT that traverses the opening 24 serves as the antenna. The antenna part ANT converts a signal of a waveguide transmission system into a signal of a coaxial transmission system. That is, the antenna part ANT and the waveguide form a waveguide coaxial converter.

In the coaxial wiring device 2 according to the second exemplary embodiment, the antenna part ANT of the waveguide coaxial converter is formed in the second port. It is sufficient that the second port be formed on the antenna part ANT. Further, it is sufficient that the opening that forms the waveguide be located in a position that serves as the waveguide either in the case in which the conductor plate 20 is arranged in such a way that the front surface of the conductor plate 20 is opposed to the first member 10 or in the case in which the conductor plate 20 is arranged in such a way that the rear surface of the conductor plate 20 is opposed to the first member 10. By employing such a structure, similar to that of the first exemplary embodiment, it is possible to manufacture the coaxial wiring device without considering which one of the front surface or the rear surface of the conductor plate 20*a* is opposed to the first member 10 also in the coaxial wiring device 2 according to the second exemplary embodiment.

Third Exemplary Embodiment

Figure 7:
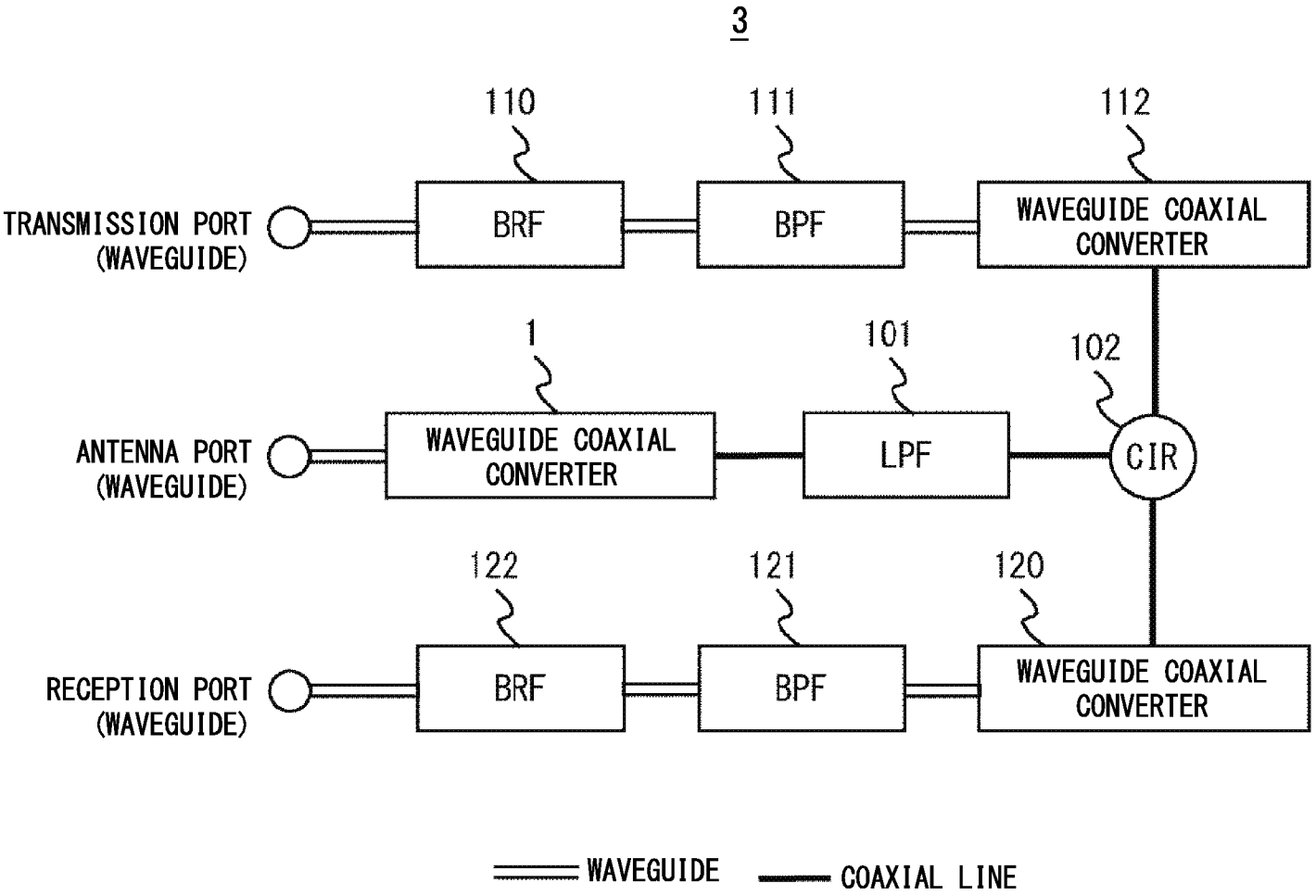
FIG. 7 is a block diagram of a transmission/reception integrated splitter according to a third exemplary embodiment.

In a third exemplary embodiment, an example in which the coaxial wiring devices 1 and 2 described in the above exemplary embodiments are applied to a transmission/reception integrated splitter will be described. FIG. 7 shows a block diagram of a transmission/reception integrated splitter 3 according to the third exemplary embodiment.

The transmission/reception integrated splitter 3 shown in FIG. 7 includes a waveguide coaxial conversion device 100, a low-pass filter 101, a circulator 102, a band-rejection filter 110, a band-pass filter 111, a waveguide coaxial converter 112, a waveguide coaxial converter 120, a band-pass filter 121, and a band-rejection filter 122.

In the transmission/reception integrated splitter 3 according to the third exemplary embodiment, the signal of the waveguide transmission system is converted into the signal of the coaxial transmission system by the waveguide coaxial converter 100 and the path from the waveguide coaxial converter 100 to the waveguide coaxial converter 112 and the path from the waveguide coaxial converter 100 to the waveguide coaxial converter 120 are formed of the coaxial transmission system. Further, the path from the band-rejection filter 110 to the waveguide coaxial converter 112 and the path from the waveguide coaxial converter 120 to the band-rejection filter 122 are formed of the waveguide transmission system.

In the transmission/reception integrated splitter 3 according to the third exemplary embodiment, a coaxial circulator (hereinafter it will be referred to as a coaxial circulator 102) is used as the circulator 102. This coaxial circulator 102 transmits a signal input through the first path (e.g., path to which a transmission port is connected) to a coaxial wire unit of the waveguide coaxial conversion device. Further, the coaxial circulator outputs a signal transmitted from the coaxial wire unit of the waveguide coaxial conversion device 1 to the second path (e.g., path to which a reception port is connected).

Further, in the transmission/reception integrated splitter 3 according to the third exemplary embodiment, a first waveguide coaxial converter (e.g., waveguide coaxial converter 112) is connected to the port of the coaxial circulator 102 on the side of the first path and a second waveguide coaxial converter (e.g., waveguide coaxial converter 120) is connected to the port of the coaxial circulator 102 on the side of the second path. The waveguide coaxial converter 112 and the waveguide coaxial converter 120 perform signal conversion between the waveguide transmission system and the coaxial transmission system by the antenna provided inside the waveguide.

In the transmission/reception integrated splitter 3, a first filter unit (e.g., the band-rejection filter 110 and the band-pass filter 111) connected between the waveguide coaxial conversion device 112 and an input port (e.g., transmission port) is provided. The path from the band-rejection filter 110 to the waveguide coaxial converter 112 is a path of the waveguide transmission system. That is, the band-rejection filter 110 and the band-pass filter 111 form a filter in accordance with the shape of the waveguide.

Further, in the transmission/reception integrated splitter 3, a second filter unit (e.g., the band-pass filter 121 and the band-rejection filter 122) connected between the waveguide coaxial conversion device 120 and an output port (e.g., reception port) is provided. The path from the waveguide coaxial converter 120 to the band-rejection filter 122 is a path of the waveguide transmission system. That is, the band-pass filter 121 and the band-rejection filter 122 form a filter in accordance with the shape of the waveguide.

In the transmission/reception integrated splitter 3 according to the third exemplary embodiment, each of the above blocks is achieved by a configuration in which a conductor plate is held between the first member and the second member. More specifically, in the transmission/reception integrated splitter 3, a coaxial wire and a conductor unit to adjust characteristics of the filter formed in the waveguide transmission system are formed on the conductor plate.

In the transmission/reception integrated splitter 3 according to the third exemplary embodiment, the low-pass filter 101 is formed by the coaxial wiring device 1 described in the above embodiment. Further, in the transmission/reception integrated splitter 3 according to the third exemplary embodiment, the paths connected to the coaxial circulator 102 are formed on both sides of the area where the low-pass filter 101 is formed in such a way that they become line symmetrical with respect to the reference line of the low-pass filter 101.

More specifically, in the transmission/reception integrated splitter 3 according to the third exemplary embodiment, the waveguide coaxial converter 112 and the first filter unit and the waveguide coaxial converter 120 and the second filter unit are formed such that they are line symmetrical with respect to the reference line of the coaxial circulator 102.

In accordance with the above description, in the transmission/reception integrated splitter 3 according to the third exemplary embodiment, the characteristics of the first filter unit and the characteristics of the second filter unit can be switched by only changing the front surface and the rear surface of the conductor plate. Therefore, in the transmission/reception integrated splitter 3 according to the third exemplary embodiment, even when there are changes in the design specification of the filter characteristics, it is possible to deal with the changes in a flexible manner without re-designing the first member 10, the conductor plate 20, and the second member 30.

When the coaxial wiring device 2 according to the second exemplary embodiment is used as the coaxial circulator 102, the waveguide coaxial converter of the coaxial wiring device 2 can be used as the waveguide coaxial converter 100.

Figure 8:
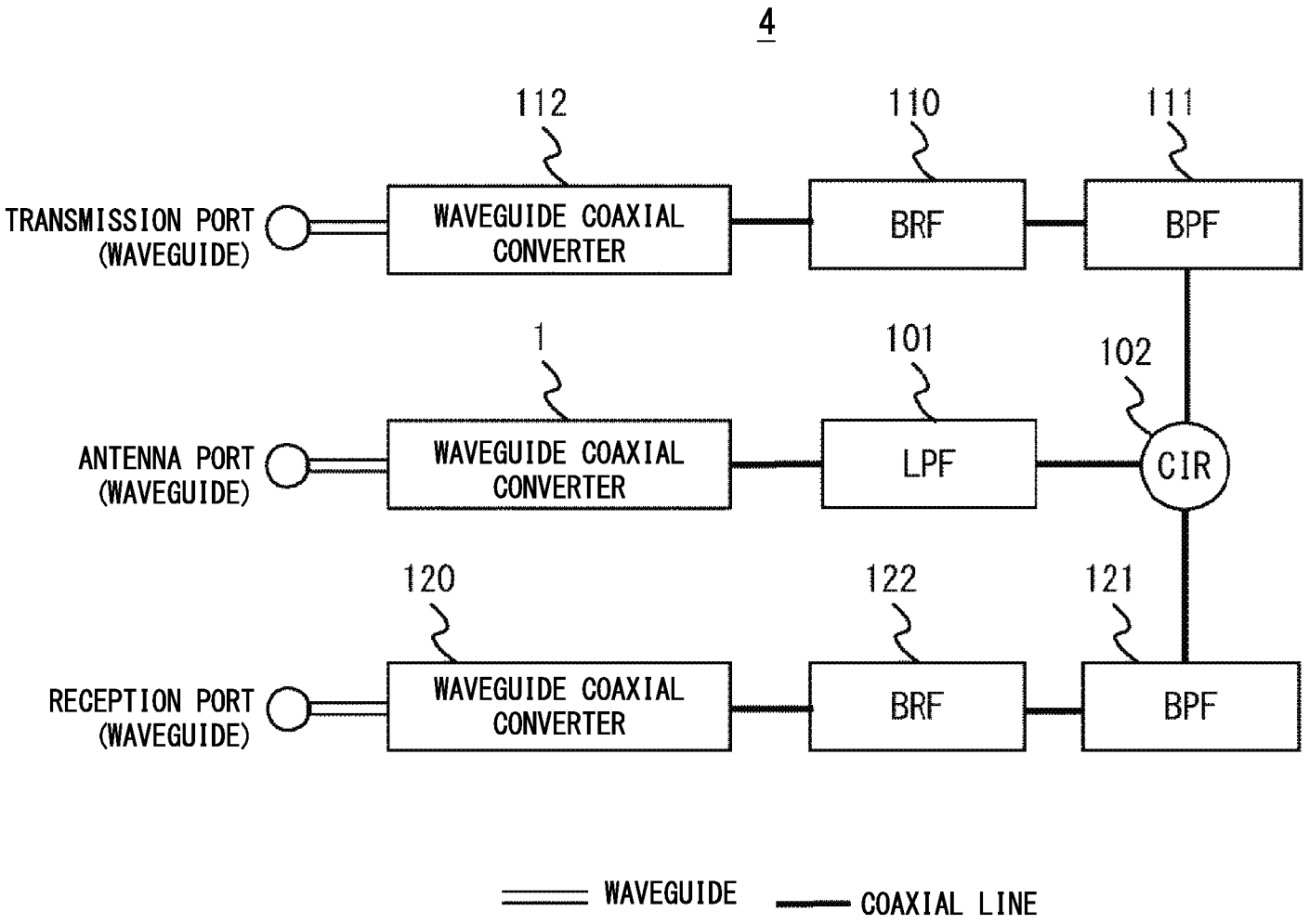
FIG. 8 is a block diagram of a modified example of the transmission/reception integrated splitter according to the third exemplary embodiment.

Further, the transmission/reception integrated splitter 3 shown in FIG. 7 may have another structure shown in FIG. 8. FIG. 8 shows a transmission/reception integrated splitter 4, which is another form of the transmission/reception integrated splitter 3. In the transmission/reception integrated splitter 4, the waveguide coaxial converter 112 is connected to the transmission port and the band-rejection filter 110 and the band-pass filter 111 formed on the coaxial line are provided between the waveguide coaxial converter 112 and the coaxial circulator 102. Further, in the transmission/reception integrated splitter 4, the band-pass filter 121 and the band-rejection filter 122 formed on the coaxial line are provided in the latter stage of the coaxial circulator 102. Then the waveguide coaxial converter 120 is provided between the band-rejection filter 122 and the reception port. As described above, the band-rejection filter 110, the band-pass filter 111, the band-pass filter 121, and the band-rejection filter 122 may be formed on the coaxial line or may be formed on the waveguide. Whether to form these filters on the coaxial line or on the waveguide can be appropriately switched depending on the use of the transmission/reception integrated splitter.

Note that the present invention is not limited to the above exemplary embodiments and may be changed as appropriate without departing from the spirit of the present invention.

This application is based upon and claims the benefit of priority from Japanese Patent Application No. 2013-210073, filed on Oct. 7, 2013, the disclosure of which is incorporated herein in its entirety by reference.

REFERENCE SIGNS LIST

1 COAXIAL WIRING DEVICE
2 COAXIAL WIRING DEVICE
3 TRANSMISSION/RECEPTION INTEGRATED SPLITTER
10 FIRST MEMBER
10*a* FIRST MEMBER
11 FIRST GROOVE
12 SECOND GROOVE

13 THIRD GROOVE
14 FOURTH GROOVE
15 FIFTH GROOVE
20 CONDUCTOR PLATE
20*a* CONDUCTOR PLATE
21 FILTER WIRE
22 SECOND WIRE
23 THIRD WIRE
24 OPENING
30 SECOND MEMBER
100 WAVEGUIDE COAXIAL CONVERTER
101 LOW-PASS FILTER
102 COAXIAL CIRCULATOR
110 BAND-REJECTION FILTER
111 BAND-PASS FILTER
112 WAVEGUIDE COAXIAL CONVERTER
120 WAVEGUIDE COAXIAL CONVERTER
121 BAND-PASS FILTER
122 BAND-REJECTION FILTER
FN1 FIRST FILTER PORT
FN2 SECOND FILTER PORT
FC FILTER UNIT CENTRAL POINT

The invention claimed is:

1. A coaxial wiring device comprising a first metallic member, a second metallic member opposed to the first member, a conductor plate that is provided to be held between the first metallic member and the second metallic member, a coaxial wire that is formed in the conductor plate, and a first port and a second port that are provided on respective ends of the coaxial wire, wherein:

a high-frequency signal is transmitted between the first port and the second port by the coaxial wire and grooves formed in the first metallic member and the second metallic member, and the coaxial wire is formed in a bent shape and with a centrosymmetric figure.

2. The coaxial wiring device according to claim 1, wherein the grooves are formed when the front surface of the conductor plate contact with the first metallic member and the back surface of the conductor plate contact with the second metallic member.

3. The coaxial wiring device according to claim 1, further comprising a second groove when the front surface of the conductor plate contact with the second metallic member and the back surface of the conductor plate contact with the first metallic member.

4. The coaxial wiring device according to claim 1, wherein the second port is provided on an antenna that converts a signal input through a waveguide into a signal that propagates on a coaxial.

* * * * *